US006736062B2

(12) United States Patent
Frank et al.

(10) Patent No.: US 6,736,062 B2
(45) Date of Patent: May 18, 2004

(54) CONVEYOR SYSTEM WITH ENCODERS FOR POSITION SENSING IN A PRINTING MATERIAL PROCESSING MACHINE

(75) Inventors: Hendrik Frank, Heidelberg (DE); Daniel Raquet, Nackarzimmern (DE); Stefan Maier, Bad Schoenborn (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/456,424

(22) Filed: Jun. 6, 2003

(65) Prior Publication Data

US 2003/0233954 A1 Dec. 25, 2003

(30) Foreign Application Priority Data

Jun. 10, 2002 (DE) ..... 102 25 540

(51) Int. Cl.[7] ..... B41F 13/24; B41F 3/58; G03G 15/00

(52) U.S. Cl. ..... 101/232; 101/248; 101/483; 101/228; 101/183; 101/479; 399/16

(58) Field of Search ..... 101/483, 232, 101/183, 228, 248, 479; 399/16, 78; 358/1.2

(56) References Cited

U.S. PATENT DOCUMENTS

| | | | | | |
|---|---|---|---|---|---|
| 3,923,139 | A | * | 12/1975 | Mesnil et al. | 400/61 |
| 4,143,771 | A | * | 3/1979 | Wieser | 209/583 |
| 4,598,850 | A | * | 7/1986 | Winterholler et al. | 226/92 |
| 4,734,868 | A | * | 3/1988 | DeLacy | 358/1.12 |
| 4,759,741 | A | * | 7/1988 | Chisholm, Jr. | 493/55 |
| 4,847,555 | A | * | 7/1989 | Stammer et al. | 324/161 |
| 5,090,316 | A | * | 2/1992 | Rodi et al. | 101/148 |
| 5,096,183 | A | * | 3/1992 | Hauck et al. | 271/227 |
| 5,313,886 | A | * | 5/1994 | Muller | 101/486 |
| 5,335,597 | A | * | 8/1994 | Helmstadter | 101/485 |
| 5,346,202 | A | * | 9/1994 | Jurkewitz | 271/258.02 |
| 5,398,603 | A | * | 3/1995 | Hartmann et al. | 101/183 |
| 5,423,257 | A | * | 6/1995 | Schramek | 101/365 |
| 5,489,358 | A | * | 2/1996 | Miciukiewicz | 156/366 |
| 5,740,054 | A | * | 4/1998 | Durr et al. | 700/122 |
| 5,771,805 | A | * | 6/1998 | Branas et al. | 101/248 |
| 6,092,801 | A | * | 7/2000 | Abbadessa et al. | 271/204 |
| 6,199,480 | B1 | * | 3/2001 | Leonhardt et al. | 101/248 |
| 6,598,529 | B2 | * | 7/2003 | Muller | 101/484 |
| 6,631,901 | B2 | * | 10/2003 | Hess et al. | 271/205 |

FOREIGN PATENT DOCUMENTS

| | | | | |
|---|---|---|---|---|
| DE | 3405294 | | 8/1985 | |
| DE | 4210958 | | 10/1993 | |
| DE | 19722376 | | 12/1997 | |
| DE | 19906638 | | 8/2000 | |
| DE | 10046466 | | 4/2001 | |
| DE | 10162448 | | 7/2002 | |
| GB | 2225556 | A * | 10/1988 | B41F/33/16 |

* cited by examiner

*Primary Examiner*—Andrew H. Hirshfeld
*Assistant Examiner*—Wasseem H. Hamdan
(74) *Attorney, Agent, or Firm*—Davidson, Davidson & Kappel, LLC

(57) ABSTRACT

A conveyor system (10) for a sheet of printing material (12) in a printing material processing machine (14), including a running member (16) which can be moved through the machine (14) along a transport path (18) using a drive (22), and including a number of encoders (24) which are arranged along the transport path (18) and used to sense the position of the running member (16), the conveyor system having the feature that the encoders (24) are connected to an evaluation unit (26) for progressive sampling of the encoder signals; it being possible for an active encoder (28) and a passive encoder (30) of the number of encoders (24) to be specified in the evaluation unit (26) so that a drive signal can be generated in a signal processor unit (32) on the basis of a change in amplitude of the signal of the active encoder (28) and a change in amplitude of the signal of the passive encoder (30).

17 Claims, 4 Drawing Sheets

CONVEYOR SYSTEM WITH ENCODERS FOR POSITION SENSING IN A PRINTING MATERIAL PROCESSING MACHINE

Priority to German Patent Application No. 102 25 540.7, filed Jun. 10, 2002 and hereby incorporated by refernce herein, is claimed.

BACKGROUND INFORMATION

The present invention relates to a conveyor system for a sheet of printing material in a printing material processing machine, including a running member which can be moved through the machine along a transport path using a drive, and further including a number of encoders which are arranged along the transport path and used to sense the position of the running member. Moreover, the present invention relates to a method for generating a drive signal of a conveyor system, including a running member, for a sheet of printing material in a printing material processing machine, by evaluating signals of a number of encoders which are distributed along a transport path of the running member.

In printing material processing machines, such as printing units, printing presses, print finishing machines (folding apparatuses, gatherer-stitchers, adhesive binders, or similar), or the like, the movement of a sheet of printing material, typically on a section of a transport path of conveying elements, can be accomplished using a conveyor system controlled in open or closed loop. The conveying elements include holding means or fixing means for holding a sheet of printing material at least during an interval of time. When moving elements, so-called "running members" on a long, in particular, closed transport path in a circuit, it is first of all required to use a suitable drive, such as a flexible drive, a rack-and-pinion drive, a linear motor, or the like; secondly, it is required to feed back the positional information to the controller for closed-loop operation.

In the case that a linear motor is used, energy supply to the conveyor system is typically provided by synchronous motors of which the secondary member is moved, that is, forms the running member. It is also possible to use a plurality of secondary members or running members. The static member includes the primary member, which is suitably segmented to be able to drive a plurality of running members on one path. In order to sense the position of the running member, that is, for signal acquisition purposes, diverse configurations of suitable encoder arrangements for generating a signal by detection and suitable detection objects have already been proposed.

To acquire the positional information of the conveyor system, different principles are available whose scale members and encoders (i.e., also sensors) can be designed and arranged differently. In the prior art, there are length measuring systems which are based on optical, magnetostrictive, electrostatic, or inductive and/or resistance principles. In principle, the measuring systems differ from each other in their measurement method, which can either be an implicitly absolute or an incremental one. A common shortcoming of known measuring systems is the limited length of their measuring path for high-accuracy position sensing at high speed. In other words, it turns out to be very difficult to achieve high position resolution at high speeds over a long section of the transport path for a running member in a transport system.

A conveyor system for conveying material in sheet form or sheets of printing material in a rotary printing press is disclosed, for example, in German Patent Application No. 197 22 376 A1. This conveyor system includes two guide rails running parallel to each other, in each of which one associated propulsion element is guided in a play-free manner, the propulsion element forming the running member of an electric linear drive. For example, according to German Patent Application No. 197 22 376 A1, the two propulsion elements are designed as link chains having at least two individual links of magnetizable material and connected by a cross-member to which are mounted grippers for holding the sheet. The propulsion elements are driven by drive stations that are located outside the guide rails and have coils which form the stator of the linear drive and which are spaced apart at distances substantially smaller than or equal to the length of the propulsion devices.

SUMMARY OF THE INVENTION

German Patent Application No. DE 101 62 448 A1 describes a device for sensing the position of a running member in a conveyor system of a printing material processing machine. A number of encoders which, in particular, can be evenly spaced apart from each other, are arranged along a position coordinate line of a (preferably closed) transport path. The conveyor system drive is preferably a linear motor; the running member has a scale member or a position mark. The scale member or the position mark can be linear in shape or punctiform. Preferred embodiments of the measuring system are optical encoders or magnetic field detectors. The encoders are arranged such that at certain positions of the running member, at least two neighboring encoders deliver non-vanishing signals. This arrangement can also be referred to as overlapping arrangement.

An object of the present invention is to provide a conveyor system for a sheet of printing material in a printing material processing machine such that the driving of the conveyor system is guaranteed with high quality.

According to the present invention, a conveyor system for a sheet of printing material in a printing material processing machine includes a running member which can be moved through the printing material processing machine along a transport path using a drive (drive control and driving element), as well as a number of encoders which are arranged along the transport path, preferably in an overlapping arrangement, and used to sense the position of the running member. The printing material is capable of being held on the running member at least along a section of the transport path or path of the running member. The encoders are connected to an evaluation unit for progressive sampling of the encoder signals. In the evaluation unit, an active encoder and a passive encoder can be specified at least for an interval of time so that in a signal processor unit of the evaluation unit a drive signal, in particular, an incremental signal, can be or is generated on the basis of a change in amplitude of the signal of the active encoder and a change in amplitude of the signal of the passive encoder. For different time intervals, the active and passive encoders can be different. The transport path of the running member is preferably closed. In said time interval, the change in amplitude of the active encoder can be used during a first period of time and the change in amplitude of the passive encoder can be used during a second period of time for generating the drive signal. Preferred encoders are so-called "sine/cosine encoders", that is, encoders having two encoders signals which are shifted in phase relative to each other.

According to the present invention, a method for generating a drive signal of a conveyor system, including a running member, for a sheet of printing material in a printing material processing machine is based on the evaluation of signals of a number of encoders which are distributed along a transport path the running member and which, in particular, can be evenly spaced apart from each other: The encoders are sampled progressively. Out of the number of encoders, an active encoder and a passive encoder are specified at least for an interval of time. A drive signal is generated on the basis of a change in amplitude of the signal of the active encoder and a change in amplitude of the signal of the passive encoder.

In different time intervals, it is possible to specify different active and passive encoders of the number of encoders. In particular, a so-called "handover" from a first active and a first passive encoder in a first time interval to a second active and a second passive encoder in a second time interval can take place. These handovers can be continued between further time intervals in a corresponding manner for further encoders. The generation of a drive signal is based on the change in amplitude of a signal of one of the number of encoders that has been determined to be the active encoder for a time interval; the active encoder or the passive encoder being monitored such that a decision can be made whether to specify a different active encoder and a different passive encoder for a different time interval.

In the conveyor system and the method according to the present invention, the evaluation of the encoder signals makes available, on one hand, the velocity information (change of position of the running member) and, on the other hand, the phase information (precise position of the running member) of the encoders distributed along the transport path: The drive signal can be generated starting from an initial value (initial amplitude and initial phase), because the required change in the drive signal for driving the conveyor system is derived from the position and the change in position of the running member and can therefore be determined. Using the change in amplitude, at a current point in time, of the encoder signal of the encoder that has been determined to be the active encoder for the current time interval, it is possible to determine the change in the drive signal with the instantaneous amplitude and the instantaneous phase at this point of time. From the examination of the change in amplitude of the signal of the active encoder and also of the change in amplitude of the signal of the passive encoder, or from the determination of the number of zeros of the signal of the passive encoder, it becomes clear whether, at the current moment, the running member has moved away from the active encoder of the number of encoders and approached another encoder, in particular the passive encoder, to such an extent that a changeover, i.e., determination of a new active encoder and a new passive encoder of the number of encoders must take place. As a consequence, in order for the distance of the old active encoder to the new active encoder to be taken into account at the input side to calculate the drive signal, a phase shift and a change in amplitude are required as a function of the above-mentioned distance compared to the motor period (i.e., the path traveled by the running member during a motor cycle). On the output side, the drive signal (instantaneous amplitude and instantaneous phase) is not changed by the encoder changeover. In other words, in the conveyor system and the method according to the present invention, the evaluation of the encoder signals uses the change in an encoder signal of a currently active encoder to generate a drive signal; different encoders being currently active encoders for different time intervals, taking into account the distances of the encoders relative to each other.

The evaluation according to the present invention is, in principle, independent of the number of encoders. A control signal is generated from a plurality of encoder signals with precision and taking into account the instantaneous velocity of the running member. The evaluation unit can be advantageously scaled according to the number of encoders. A downstream drive is relieved from the processing of a number of encoder signals, because a drive signal is generated in the evaluation unit. In other words, the incremental changeover is relocated; only a generated incremental signal is transferred. Furthermore, a changeover from a first active encoder to a second active encoder is easily accomplished based on the determination of the number of zeros of the signal of the passive encoder by counting. This minimal information is sufficient to allow an assessment as to whether the position of the running member in the conveyor system can still be determined with sufficient accuracy using the signal of the first active encoder.

The evaluation unit of the conveyor system according to the present invention can include at least one multiplexer for the encoder signals as well as a control unit. A preferred cycle time is below 250 microseconds. For the conveyor system according to the present invention, it is preferred that the drive of the conveyor system is a variable-speed drive and that the drive signal is a measure of the actual value of the position of the running member. It is clear to one skilled in the art that it is also possible to generate a plurality of drive signals for a plurality of running members. In other words, the conveyor system can include a control device, which can be linked to the machine control to exchange data and/or signals, in particular setpoint values and actual values for the position of the running member or members.

In a preferred embodiment, the drive of the inventive conveyor system for a sheet of printing material in a printing material processing machine is a linear motor. Moreover, the evaluation unit can contain at least one analog-to-digital converter, and the signal processor unit can be a digital signal processor unit. In a further refinement, the evaluation unit can contain at least one digital-to-analog converter, in which at least one output signal of the signal processor unit can be converted.

It is particularly advantageous if in the inventive conveyor system for a sheet of printing material, each two successive encoders of the number of encoders along the transport path are substantially equally spaced apart. For the drive, this means that an equal phase shift or an equal period of time occurs between the positions of two encoders in relation to the cycle of the drive. Moreover, provision can be made for at least one reference pulse generator or an absolute encoder. In this manner, an initial phase can be determined for the drive of the running member in an easy way.

A preferred encoder type is magnetic field detectors; the running member featuring a scale member having a magnetic pattern (dipole, multipole, or regular magnetization pattern, such as a stripe pattern, or the like). At this point, it should be mentioned that the topology and the mode of operation of the evaluation unit are independent of the measurement method used. However, non-optical, magnetic or inductive detection is particularly advantageous when processing printing material in an environment in which absolute cleanness is not always guaranteed.

The conveyor system according to the present invention can advantageously be used in a printing unit, in particular, in a planographic printing unit, a flexographic printing unit, or an offset printing unit. In other words, a printing unit according to the present invention features a conveyor system according to the present invention. A printing unit according to the present invention can be used, in particular, in a printing press. In this context, the printing press can have a continuous drive for moving the sheets of printing material, or a number of individual drives. In other words, a printing press according to the present invention has at least one inventive printing unit, in particular, also a feeder and a delivery. A preferred embodiment of a printing press according to the present invention includes a feeder, at least one printing unit, and a delivery. An alternative embodiment includes a feeder, at least one printing unit, and a finishing unit. The finishing unit is, for example, a varnishing unit, a dryer, a cutting device, or a print finishing machine. The preferred embodiment and the alternative embodiment are characterized by at least one conveyor system according to the present invention. The conveyor system according to the present invention can be used for moving or transporting between the feeder and a printing unit and/or between a printing unit and a further printing unit and/or between a printing unit and a delivery and/or between a printing unit and a finishing unit. Typically, a printing press according to the present invention contains four, five, eight, or ten printing units.

The method according to the present invention for generating a drive signal of a conveyor system for a sheet of printing material in a printing material processing machine can be further developed in an advantageous manner in that the initial phase of the drive signal is determined by measuring the position of the running member at a first point in time. Moreover, provision can be made to specify a different active encoder and a different passive encoder when a certain number of zeros of the signal of the passive encoder has been counted. Preferably, the other active encoder is the current passive encoder.

During changeover from a first active encoder and a first passive encoder to a second active encoder and a second passive encoder, it is possible, knowing the distance between the first and second active encoders, knowing the distance between the first and second passive encoders as well as the path traveled during a motor cycle, to infer the associated phase shift of the drive signal in a simple and accurate manner.

In the context of the inventive idea, there is also-a method for open-loop control of a drive of a conveyor system for a sheet of printing material in a printing material processing machine, a drive signal being generated by evaluating signals of a number of encoders according to the method of the present invention. The described technical teaching also discloses a method for closed-loop control of a drive of a conveyor system for a sheet of printing material in a printing material processing machine, a drive signal being generated as a measure of the actual value of the position of the running member by evaluating signals of a number of encoders according to the method of the present invention.

BRIEF DESCRIPTION OF THE DRAWINGS

Further advantages as well as expedient embodiments and refinements of the present invention will be depicted by way of the following Figures and the descriptions thereof, in which.

DETAILED DESCRIPTION

Figure 1:
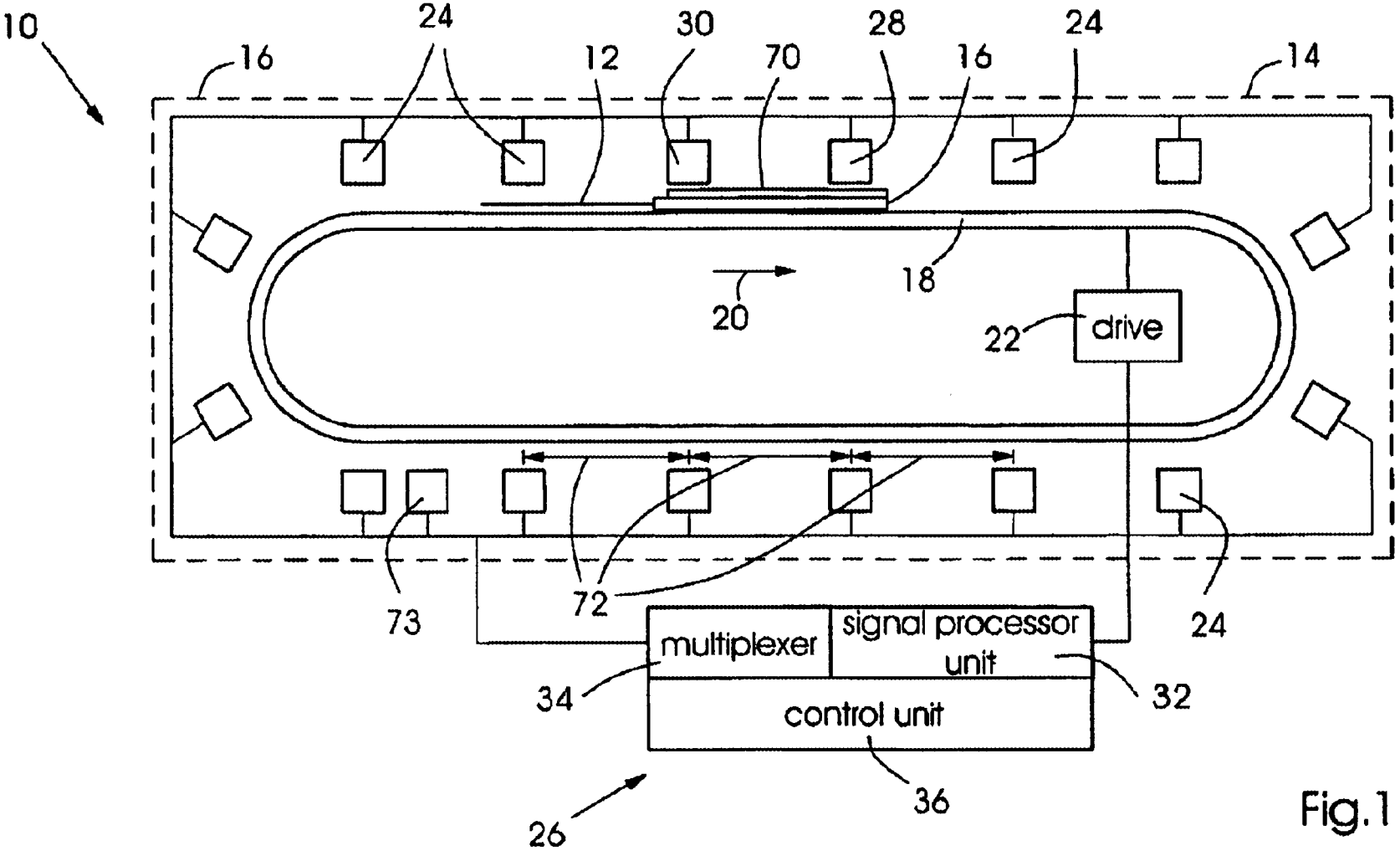
FIG. 1 is a schematic representation of an embodiment of a conveyor system for a sheet of printing material in a printing material processing machine, including an evaluation unit according to the present invention.

FIG. 1 shows a schematic detail view of an advantageous embodiment of an evaluation unit of the inventive conveyor system in a printing material processing machine. The inventive conveyor system 10 for a sheet of printing material 12 in a printing material processing machine 14 includes a running member 16 which can move through the printing material processing machine 14 along a transport path 18 in transport direction 20. The transport of sheet of printing material 12 takes place at least on a section of transport path 18, that is, from a first point to a second point. As shown in this embodiment by way of example, sixteen encoders 24, preferably sine/cosine encoders, are arranged along transport path 18; neighboring encoders 24 being spaced apart at regular intervals 72. In this embodiment, provision is also made for a reference signal generator 73. Alternatively, however, the role of reference signal generator 73 can also be assumed by one encoder of the number of encoders 24. Held on running member 16 is a scale or sensor member 70 which produces signals when passing along transport path 18 near an encoder 24 and near reference signal generator 73. FIG. 1 shows a situation where running member 16 is located near an encoder 28. This encoder is specified as active encoder 28. The passive encoder is the encoder that is still covered or overlapped by scale member 70, but, unlike active encoder 28, not directly used for position calculation. In other words, when the scale member sweeps over two encoders, the encoder of the two encoders that is not directly used for position determination is defined or specified as the passive encoder. Consequently, the passive encoder can be located either in transport direction 20 or in a direction opposite to transport direction 20, as viewed from active encoder 28. In the situation shown in FIG. 1, neighboring encoder 30 which, when viewed from behind in transport direction 20, is located in front of active encoder 28, is specified as passive encoder 30. It is preferred for the scale member 70 to be longer than the interval 72 between neighboring encoders 24. The movement of running member 16 along transport path 18 is produced by a drive 22. Encoders 24 and reference signal generator 73 are linked to an evaluation unit 26. Evaluation unit 26 includes at least one signal processor unit 32, a multiplexer 34 for the various signal inputs of the number of encoders 24, and a control unit 36. Signal processor unit 32 generates a drive signal for drive 22 of conveyor system 10.

A preferred changeover of active and passive encoders will be explained again in other words; scale member 70 being longer than the interval between neighboring encoders. In a first situation, scale member 70 is assumed to overlap with only one encoder 24. This encoder is then specified as active encoder 28. Then, the passive encoder can be, in particular, the next encoder in transport direction 20 or the previous encoder with respect to active encoder 28 as viewed in transport direction 20. In a second situation, scale member 70 is assumed to overlap with currently active encoder 28 and the next encoder in the transport direction. This encoder is then specified as currently passive encoder 30. In a third situation, which is temporally subsequent to the second situation and in which scale member 70 still overlaps with two encoders, the roles of the two encoders are changed: The next encoder becomes currently active encoder 28 and the previously active encoder becomes currently passive encoder 30. This situation corresponds to the one shown in FIG. 1. In a fourth situation, preferably when scale member 70 approaches a further neighboring encoder 24 in the transport direction, this neighboring encoder becomes the currently passive encoder. Further changeovers for handover from one encoder to the next, are iterated according to the individual situations or continued analogously.

In an advantageous refinement, the changeover from a first encoder to a second encoder in a transport direction can take place as follows: Initially, the first encoder is the currently active encoder. At a first position of the scale member, the second encoder is specified as the currently passive encoder. At a second position, which can coincide with the first one or be located downstream in the transport direction, the currently passive encoder is reset to an initial value. When viewed in a downstream direction, there exist a third and a fourth position. At the fourth position, the first encoder becomes passive and the second encoder becomes active. At the third position, which is located between the second and the fourth positions, the role of the first encoder is switched with the role of the second encoder when the scale member moves in a direction opposite to the transport direction (typically slightly, as described below) and the second encoder is the active encoder and the first encoder is the passive encoder.

In a first embodiment, the system design of evaluation unit 26 includes an analog-to-digital converter of the sine/cosine tracks of encoders 24; the signals are processed digitally. Digital signal processing of the sine/cosine tracks of active encoder 28 and of the sine-cosine tracks of passive encoder 30 is carried out in signal processing unit 32 to generate a resulting digital sine/cosine signal as a drive signal for drive 22. The drive signal generated is converted by a digital-to-analog converter and made available to a conventional incremental encoder card of drive 22.

In a second embodiment, the system design of evaluation unit 26 includes analog-to-digital conversion of the sine/cosine tracks of encoders 24; the signals are processed digitally. Digital signal processing of the sine/cosine tracks of active encoder 28 and of the sine-cosine tracks of passive encoder 30 is carried out in signal processing unit 32 to generate a resulting digital sine/cosine signal as a drive signal for drive 22. The digital positional information is determined by comparison with an arc tangent table, the digital positional information being further processed in the motor controller of the drive.

In an advantageous refinement of an embodiment as shown in FIG. 1, provision can be made that the changeover from a first active encoder to a second active encoder, in particular, the passive encoder, in a first transport direction 20 compared to the changeover from a second active encoder to a first active encoder, in particular, the passive encoder, in the second transport direction opposite to the first transport direction, exhibits a hysteresis as a function of the position of running member 16 in conveyor system 10. In other words: When considering a pair of encoders in the two opposite transport directions, then the first, leading encoder is initially specified as the active encoder, and the second, trailing encoder is specified as the passive encoder. In this context, a changeover, in particular, the switching of the passive and active encoders, takes place at a first position when running member 16 moves in a first transport direction 20, and takes place at a second position, which, a priori, does not coincide with the first position, when running member 16 moves in a direction opposite to first transport direction 20.

Furthermore, different handovers can be provided for the change from a first active to a second active encoder.

In order to identify the activity state of an encoder (active encoder or passive encoder), that is, to clarify the question of whether a scale member is currently located below an encoder or overlaps with the encoder, an amplitude criterion is used, as explained in this description. The activity state of an encoder is defined as a function of its signal amplitude. If this signal amplitude exceeds a certain threshold value, in one embodiment for example 0.07 V, it is possible to evaluate the encoder signals, for example, the sine/cosine signals. In this procedure, however, a difficulty can arise because the signal amplitude includes noise about a mean signal value: Noise can cause an activity signal to change from the active level (high) to the non-active level (low) again, in spite of continuous movement in the transport direction.

To prevent this unwanted behavior, the incremental signal can also be evaluated in addition to the signal amplitude. An advantageous procedure includes the following steps: If the scale member moves in one direction, for example, in the transport direction, encoder n is active and the signal amplitude of encoder n+1 is just exceeding the threshold value, encoder n+1 is set to the active condition or to the active state, as well. The actual position value which is provided by encoder n and at which encoder n+1 was activated is stored. If the signal amplitude of encoder n+1 falls below the threshold value, its condition or state remains active until the scale member moves out of the overlap with the encoder in the same direction, for example, in the transport direction. Should the scale member move in the opposite direction, i.e., for example, in a direction opposite to the transport direction, then a return to the non-active condition or to the non-active state is carried out only after a certain predetermined distance (hysteresis loop). The actual encoder changeover is carried out subsequently.

Figure 2:
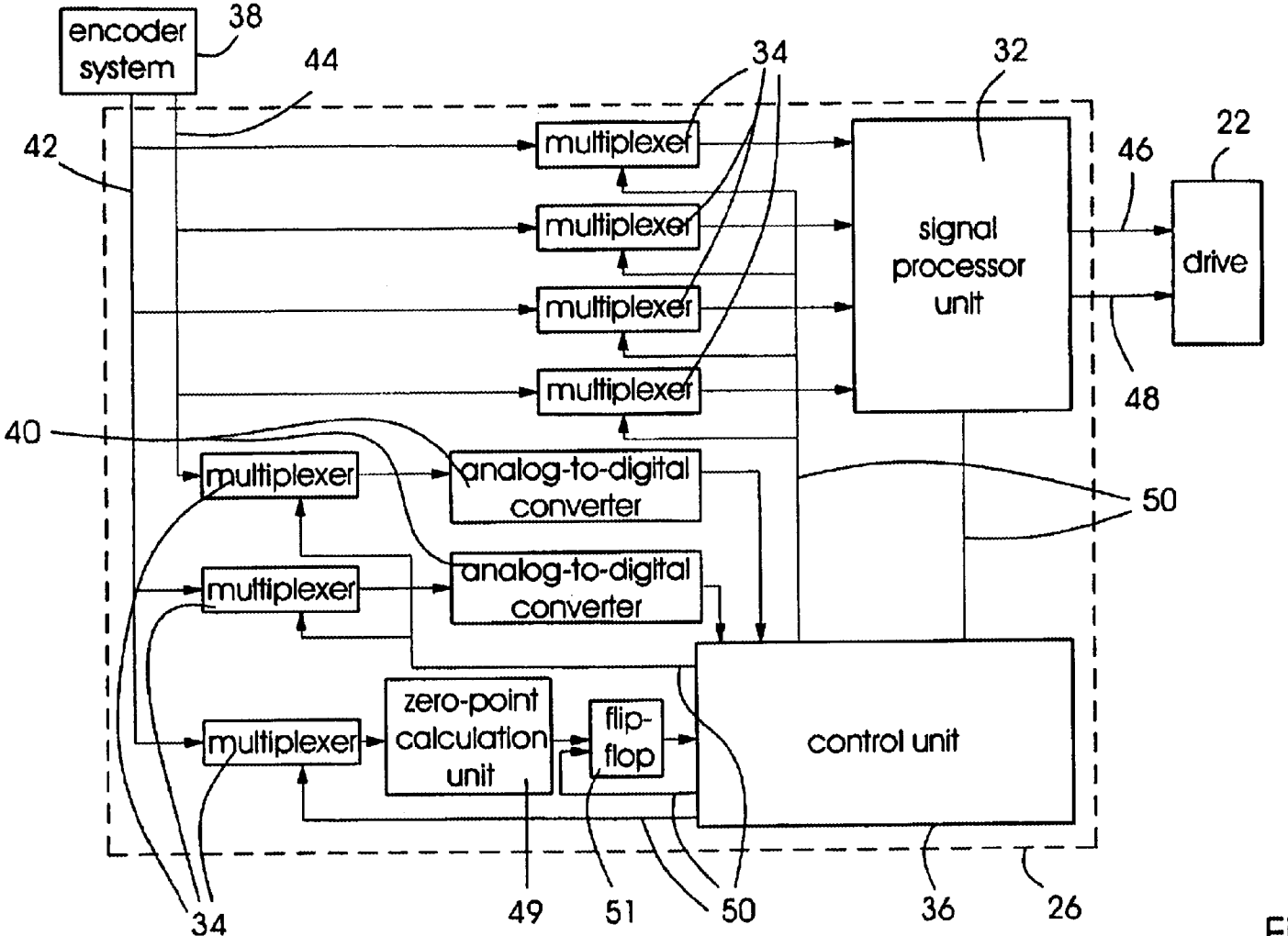
FIG. 2 shows a schematic detail view of an advantageous embodiment of an evaluation unit of the inventive conveyor system in a printing material processing machine.

FIG. 2 is a schematic detail view of an advantageous embodiment of an evaluation unit of the inventive conveyor system in a printing material processing machine. In this FIG. 2, the number of encoders 24 of conveyor system 10 shown in FIG. 1 is represented as an encoder system 38 which feeds a sine track 42 and a consine track 44 to evaluation unit 26. In a preferred embodiment, each individual encoder of the encoder system has a sine track and a cosine track; here, in this description, combined into one track, respectively. Sine track 42 and cosine track 44 branch into different multiplexers 34. There exist two sine track feed lines with multiplexers 34 and two cosine track feed lines with multiplexers 34 for signal processor unit 32, as described in more detail with respect to FIG. 3. There also exist a sine track feed line with multiplexer 34 and a cosine track feed line with multiplexer 34 for control unit 36, an analog-to-digital converter 40 being arranged downstream of each multiplexer 34. Moreover, provision is made for a sine track feed line with a multiplexer 34, a zero-point calculation unit 49, and a flip-flop 51 whose output is fed to control unit 36. Control connections 50 are provided between signal processor unit 32 and control unit 36 as well as between control unit 36 and multiplexers 34, and between control unit 36 and flip-flop 51. Signal processor unit 32 has an output for sinusoidal drive signal 46 and an output for cosinusoidal drive signal 48. The two drive signals are fed to drive 22 of conveyor system 10.

The already mentioned encoder changeover is carried out in control unit 36. An advantageous embodiment of a control unit 36 is a PIC microcontroller. In order to determine the current signals of the number of encoders, control unit 36 cyclically samples the levels or the amplitudes on sine tracks 42 and cosine tracks 44 of encoder system 38 via the already mentioned two multiplexers 34 with downstream analog-to-digital converters 40. The magnitude of the signal amplitude on the incremental tracks can be calculated from this information. If, for a certain encoder, this value exceeds a threshold value, that is, if the scale member of the running member has come close to it, then this encoder is to be specified or established as the active encoder. In a preferred embodiment, the neighboring encoder in the transport direction is specified or established as the passive encoder. However, in an overlapping arrangement, an encoder which is located further away can also be selected as the passive encoder. Control unit 36 also generates signals for switching the active and passive encoders. The zero crossings of sine track 42 are used for increasing a counter (alternatively, cosine track 44 can be used as well). To this end, the zero crossings of the next encoder, that is, of the passive encoder which is the neighboring encoder in the transport direction, are determined using a zero-point calculation unit 49 and a flip-flop SR-FF 51. Flip-flop 51 is reset by control unit 36 as soon as the corresponding counter has been incremented or increased. The changeover is then preferably based on the following assignment rule: The currently passive encoder becomes the new active encoder, and the next encoder neighboring the currently passive encoder in the transport direction becomes the new passive encoder. The sinusoidal and cosinusoidal signals of the thus determined active and passive encoders are made available to signal processor unit 32.

Figure 3:
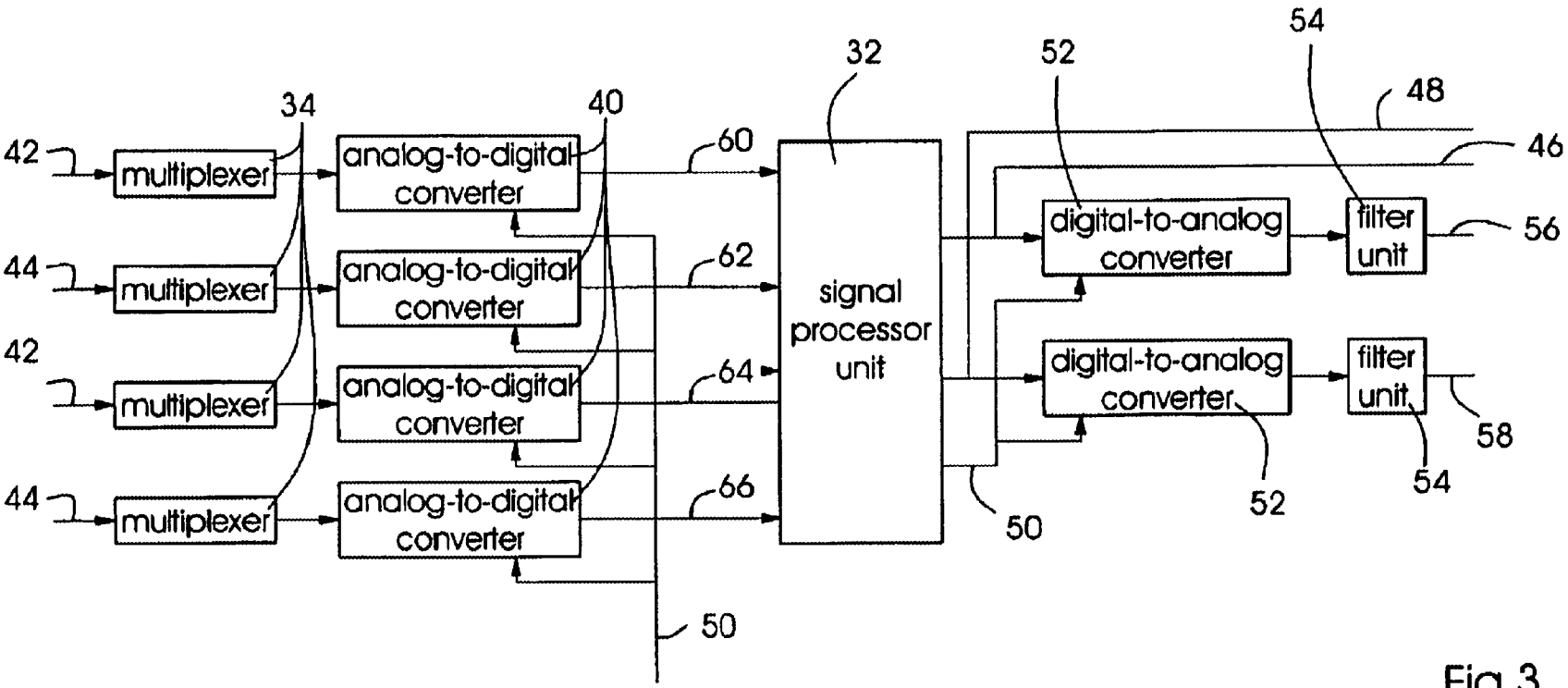
FIG. 3 is a schematic detail view of an embodiment of the signal processor unit in the evaluation unit of the conveyor system according to the present invention.

FIG. 3 schematically relates to a schematic detail view of an embodiment of signal processor unit 32 in evaluation unit 26 of conveyor system 10 according to the present invention. There are shown the four inputs of signal processor unit 32, including active sine input track 60, active cosine input track 62, passive sine input track 64, and passive cosine input track 66. Active sine input track 60 and passive sine input track 64 are obtained from branches of sine track 42 with the assistance of multiplexer 34 and analog-to-digital converter 40. Active cosine input track 62 and passive cosine input track 66 are obtained from branches of cosine track 44 with the assistance of multiplexer 34 and analog-to-digital converter 40. Analog-to-digital converters 40 receive control signals via control connections 50. There are shown two branching outputs of signal processor unit 32, on one hand, sinusoidal drive signal 46 and, on the other hand, cosinusoidal drive signal 48. One branch of each of the outputs directly delivers a digital signal, and one branch of each of the outputs is fed to a digital-to-analog converter 52 which has a filter unit 54 arranged downstream thereof, so that it is also possible to generate analog drive signals in the form of an analog sinusoidal drive signal 56 and an analog cosinusoidal drive signal 58.

Using signal processor unit 32, a motor controller within a conveyor system having a multi-encoder arrangement is relieved from the task of processing a plurality of encoder signals. The generated signals are a sinusoidal drive signal and a cosinusoidal drive signal, i.e., a drive signal of an incremental channel. In other words, the presence of only one encoder is simulated to the motor controller based on the information of the signals of a plurality of encoders. At the moment of power-up, signal processor unit 32 simulates the incremental profile of the encoder that is currently active at the very moment of power-up. To this end, the current phase angles of the sine and cosine tracks are measured during the start-up. During running operation, in a particular time interval, the current angular positions of the sine and cosine tracks of the encoder that is currently active in this particular time interval are progressively sampled and mathematically combined with the angular positions measured in the previous sampling step in order to determine the current velocity, that is, the frequency of the sine and cosine oscillations. At the outputs of signal processor unit 32, a sinusoidal drive signal 46 and a cosinusoidal drive signal 48 are generated by using only the frequency information while the phase information is insignificant. The phase was already determined at the moment of power-up. If it is now necessary to switch between encoders, then it is required to determine the frequencies of the sine and cosine oscillations of both the active encoder and the passive encoder. If, triggered by control unit 36, a changeover is carried out, i.e., if, for a different time interval, a different encoder is specified as the active encoder and a different encoder is specified as the passive encoder, then the values of the active encoder and of the passive encoder must also be accordingly exchanged for the previous sampling step of the changeover.

With regard to the embodiment illustrated in FIG. 2 and FIG. 3, the following additional observations should be made: Possible embodiments for multiplexers 34 used are multiplexers of the construction types MAX306 or MAX336. A possible embodiment for the digital-to-analog converters used is the construction type AD7476; a possible embodiment for the analog-to-digital converters used is the construction type AD5320.

Figure 4:
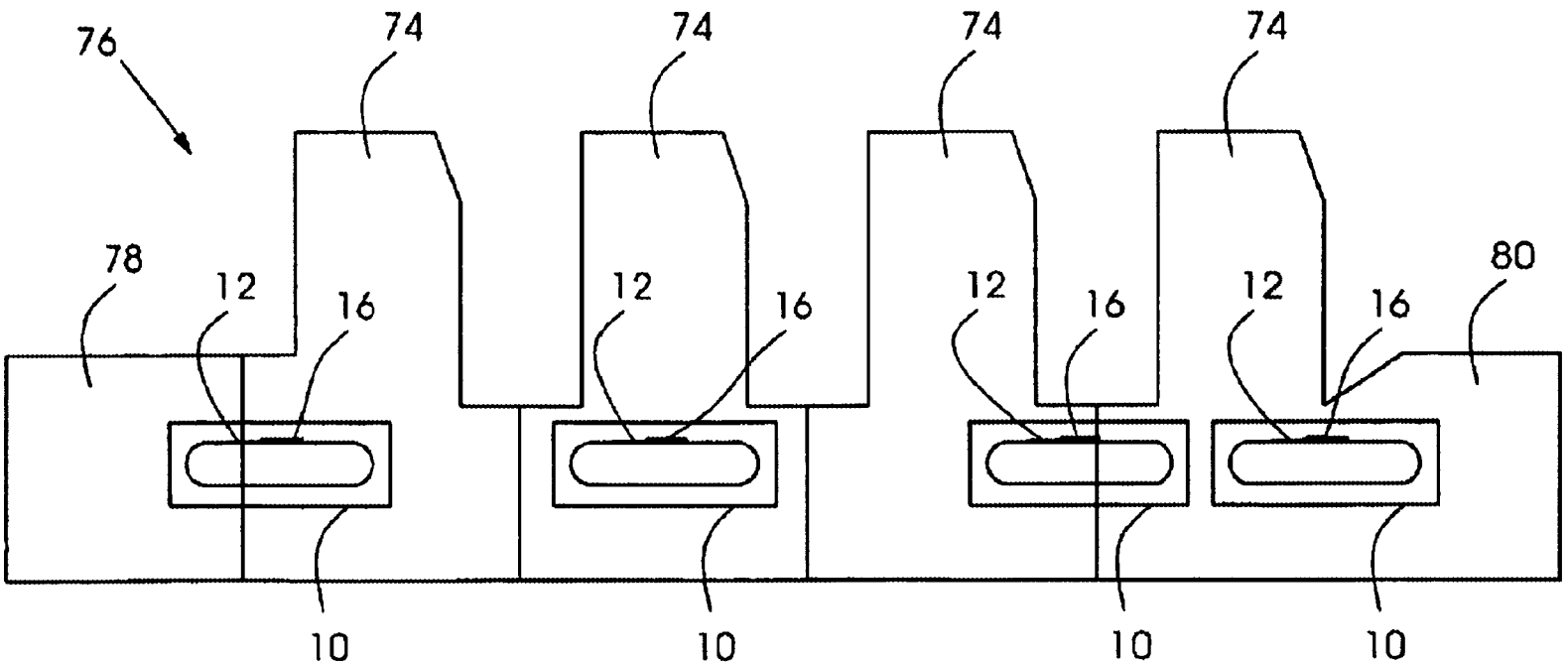
FIG. 4 depicts a printing press containing four conveyor systems according to the present invention in different arrangements compared to the components of the printing press.

FIG. 4 is a schematic view of a printing press containing four conveyor systems according to the present invention in different arrangements compared to the components of the printing press. One embodiment of a sheet-fed printing press 76 has four printing units 74, a feeder 78 and a delivery 80. In this embodiment, an inventive conveyor system 10 for a sheet of printing material 12 including a running member 16 is provided between feeder 78 and a first printing unit 74. Second printing unit 74 features an inventive conveyor system 10 for a sheet of printing material 12 including a running member 16. An inventive conveyor system 10 for a sheet of printing material 12 including a running member 16 is shown between third and fourth printing units 74. Finally, an inventive conveyor system 10 for a sheet of printing material 12 including a running member 16 is provided between fourth printing unit 74 and delivery 80.

LIST OF REFERENCE NUMERALS

10 conveyor system
12 sheet of printing material
14 printing material processing machine
16 running member
18 transport path
20 transport direction
22 driver
24 encoder
26 evaluation unit
28 currently active encoder
30 currently passive encoder
32 signal processor unit
34 multiplexer
36 control unit
38 encoder arrangement
40 analog-to-digital converter
42 sine track
44 cosine track
46 sinusoidal drive signal
48 cosinusoidal drive signal

49 zero-point calculation unit
50 control connection
51 flip-flop
52 digital-to-analog converter
54 filter unit
56 analog sinusoidal drive signal
59 analog cosinusoidal drive signal
60 active sine input track
62 active cosine input track
64 passive sine input rack
66 passive cosine input track
70 scale number
72 interval between neighboring encoders
73 reference pulse generator
74 printing unit
76 printing press
78 feeder
80 delivery

What is claimed is:

1. A conveyor system for a sheet of printing material in a printing material processing machine, the conveyor system comprising:

a drive;

a running member movable through the machine along a transport path using the drive;

a plurality of encoders arranged along the transport path for sensing a position of the running member;

an evaluation unit, the encoders being connected to the evaluation unit for progressive sampling of encoder signals, the evaluation unit capable of specifying from the plurality of encoders for an interval of time an active encoder having an active encoder signal and a passive encoder having a passive encoder signal; and a signal processor unit for generating a drive signal as a function of a change in amplitude of the active encoder signal and a change in amplitude of the passive encoder signal.

2. The conveyor system as recited in claim 1 wherein the evaluation unit includes at least one multiplexer for the encoder signals and includes a control unit.

3. The conveyor system as recited in claim 1 wherein the drive is a variable-speed drive and the drive signal is a measure of an actual value of a position of the running member.

4. The conveyor system as recited in claim 1 wherein the drive is a linear motor.

5. The conveyor system as recited in claim 1 wherein the evaluation unit contains at least one analog-to-digital converter, and the signal processor unit is a digital signal processor unit.

6. The conveyor system as recited in claim 1 wherein the evaluation unit contains at least one digital-to-analog converter for converting at least one output signal of the signal processor unit.

7. The conveyor system as recited in claim 1 wherein two successive encoders of the plurality of encoders along the transport path are spaced at equal intervals.

8. The conveyor system as recited in claim 1 wherein the encoders are magnetic field detectors and the running member features a scale member having a magnetic pattern.

9. The conveyor system as recited in claim 1 further comprising at least one reference pulse generator or wherein at least one of the plurality of encoders functions as an absolute encoder.

10. A printing unit comprising at least one conveyor system for a sheet of printing material, the conveyor system including:

a drive;

a running member movable through the printing unit along a transport path using the drive;

a plurality of encoders arranged along the transport path for sensing a position of the running member;

an evaluation unit, the encoders being connected to the evaluation unit for progressive sampling of encoder signals, the evaluation unit capable of specifying from the plurality of encoders for an interval of time an active encoder having an active encoder signal and a passive encoder having a passive encoder signal; and a signal processor unit for generating a drive signal as a function of a change in amplitude of the active encoder signal and a change in amplitude of the passive encoder signal.

11. A printing press comprising:

at least one printing unit having at least one conveyor system for a sheet of printing material, the conveyor system including:

a drive;

a running member movable through the printing unit along a transport path using the drive;

a plurality of encoders arranged along the transport path for sensing a position of the running member;

an evaluation unit, the encoders being connected to the evaluation unit for progressive sampling of encoder signals, the evaluation unit capable of specifying from the plurality of encoders for an interval of time an active encoder having an active encoder signal and a passive encoder having a passive encoder signal; and a signal processor unit for generating a drive signal as a function of a change in amplitude of the active encoder signal and a change in amplitude of the passive encoder signal.

12. A printing press comprising:

a feeder;

at least one printing unit;

a delivery or a finishing unit; and at least one conveyor system for conveying a sheet of printing material at least between the feeder and the printing unit, between a first printing unit of the at least one printing unit and a second printing unit of the at least one printing unit, or between the at least printing unit and the delivery or the finishing unit, the at least one conveyor system including:

a drive;

a running member movable along a transport path using the drive;

a plurality of encoders arranged along the transport path for sensing a position of the running member;

an evaluation unit, the encoders being connected to the evaluation unit for progressive sampling of encoder signals, the evaluation unit capable of specifying from the plurality of encoders for an interval of time an active encoder having an active encoder signal and a passive encoder having a passive encoder signal; and a signal processor unit for generating a drive signal as a function of a change in amplitude of the active encoder signal and a change in amplitude of the passive encoder signal.

13. A method for generating a drive signal of a conveyor system including a running member for a sheet of printing material in a printing material processing machine through evaluation of signals of a plurality of encoders distributed along a transport path of the running member, the method comprising:

progressively sampling the encoders;

specifying an active encoder and a passive encoder of the plurality of encoders; and generating a drive signal as a function of a change in amplitude of a signal of the active encoder and a change in amplitude of a signal of the passive encoder.

14. The method as recited in claim 13 wherein an initial phase of the drive signal is determined by measuring a position of the running member at a first point in time.

15. The method as recited in claim 13 further comprising specifying a different active encoder and a different passive encoder of the plurality of encoders when a certain number of zeros of the signal of the passive encoder has been counted.

16. A method for open-loop control of a drive of a conveyor system for a sheet of printing material in a printing material processing machine, the conveyor system including a running member for a sheet of printing material in a printing material processing machine through evaluation of signals of a plurality of encoders distributed along a transport path of the running member, the method comprising:

progressively sampling the encoders;

specifying an active encoder and a passive encoder of the plurality of encoders; and generating a drive signal as a function of a change in amplitude of a signal of the active encoder and a change in amplitude of a signal of the passive encoder.

17. A method for closed-loop control of a drive of a conveyor system for a sheet of printing material in a printing material processing machine, the conveyor system including a running member for a sheet of printing material in a printing material processing machine through evaluation of signals of a plurality of encoders distributed along a transport path of the running member, the method comprising:

progressively sampling the encoders;

specifying an active encoder and a passive encoder of the plurality of encoders; and generating a drive signal as a function of a change in amplitude of a signal of the active encoder and a change in amplitude of a signal of the passive encoder, the drive signal being a measure of an actual value of the position of the running member.

* * * * *